US005144696A

United States Patent [19]

Kahl

[11] Patent Number: 5,144,696

[45] Date of Patent: Sep. 8, 1992

[54] ARTICLE OF CLOTHING

[76] Inventor: Judith A. Kahl, 1812 Wilderness Cir., Gibsonia, Pa. 15044

[21] Appl. No.: 725,640

[22] Filed: Jul. 3, 1991

[51] Int. Cl.[5] ..... A42B 5/00

[52] U.S. Cl. ..... 2/207; 2/198; 2/103; 2/311; 2/336; 2/338; 123/273

[58] Field of Search ..... 2/207, 198, 197, 103, 2/311, 336, 338; 123/273

[56] References Cited

U.S. PATENT DOCUMENTS 2,405,921 8/1946 Wipper et al. ..... 2/149
3,154,791 11/1964 Serrano ..... 2/148
3,231,900 2/1966 Gettinger ..... 2/207
3,748,661 7/1973 Smith ..... 2/207
5,044,385 9/1991 Rhodes ..... 132/273

*Primary Examiner*—Werner H. Schroeder
*Assistant Examiner*—Gloria Hale
*Attorney, Agent, or Firm*—James Ray & Associates

[57] ABSTRACT

An article of clothing comprises an elongated fabric tube and a generally circular elastic band wherein, by passing the band over different parts of the tube, various decorative and functional article forms are provided.

19 Claims, 4 Drawing Sheets

ARTICLE OF CLOTHING

FIELD OF THE INVENTION

This invention relates to the field of clothing, and particularly to a two-piece article of clothing wherein the two pieces can be arranged in various configurations to provide different decorative appearances and functional purposes.

BRIEF DESCRIPTION OF THE INVENTION

In accordance with this invention, there is provided a first article part consisting of a generally tubular flexible material such as a piece of woven fabric which, in cooperation with a second article part comprising a generally circular elastic band, can be formed into one or another of a number of different configurations of decorative and functional purpose and value.

Figure 19:
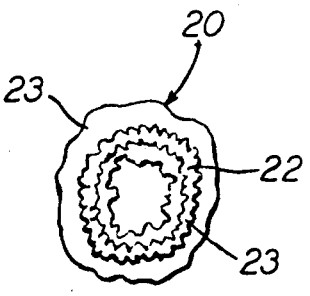

An end elevational view of ring 18 is shown in FIG. 19.

Figure 20:
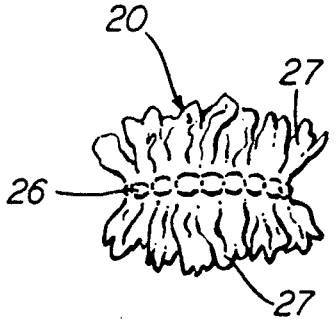

FIG. 20 is a side elevational perspective view of another embodiment with a single elastic band with fabric flounced and flaring outwardly of the band.

Figure 21:
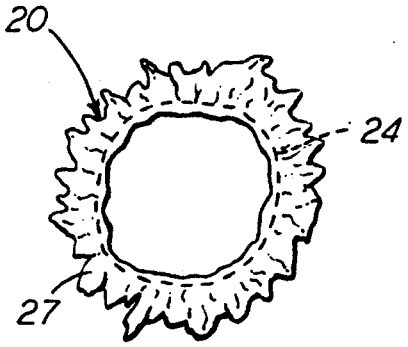

FIG. 21 shows an end elevational view of ring 20.

DETAILED DESCRIPTION OF THE INVENTION

Figure 1:
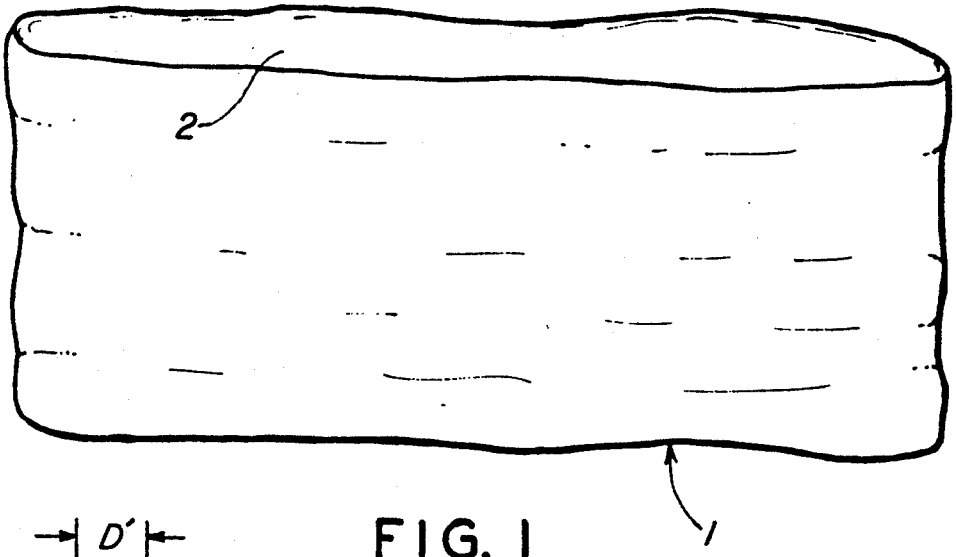
FIG. 1 is a perspective view of the first article part, hereinafter called the "tube," generally denoted by the numeral 1 and having hollow interior 2, a diameter, D, defining a length dimension of the tube, and a width, W.
Figure 2:
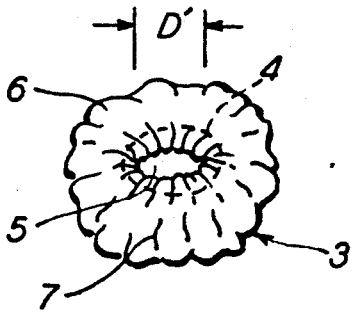
FIG. 2 is a perspective view of the second article part or generally toroidal form, generally denoted by the numeral 3 and having an opening 5 therein for passage therethrough of the tube 1. For convenience, this part hereinafter is called the "ring."

As shown in FIGS. 1 and 2, the inventive article of clothing consists of two elements, a first article part consisting of a tubular piece of flexible material, such as a decorative woven fabric, having an interior hollow 2, and a ring-like second part 3 comprising at least one elastic band, indicated in dashed lines by the numeral 4, As illustrated in FIG. 2, the ring 3 preferably is covered with a flexible covering or shell 6 such as a decorative fabric. Such fabric covering material is pleated, as at 7 in FIG. 2, so that, in a contracted condition of the elastic band, the pleats 7 of the covering material are compressed close together. Sufficient covering materials is provided so that the pleated material, when spread apart, will accommodate a fully expanded condition of the elastic band 4.

Figure 5:
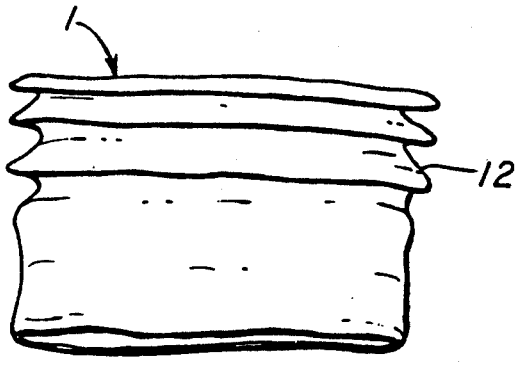
FIG. 5 is a perspective plan view of the tube 1 in partially folded condition, with a few partially-completed lengthwise folds or pleats 12 formed therein.
Figure 6:
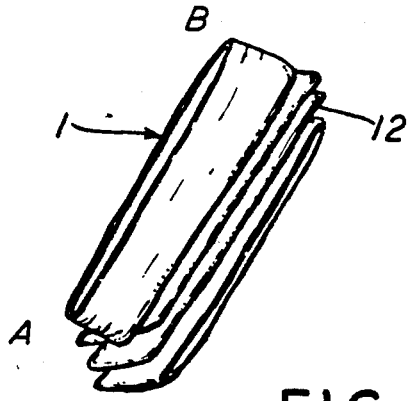
FIG. 6 is a perspective view of tube 1 in substantially completely lengthwise-folded condition with a plurality of folds or pleats 12 formed therein.

The ring 3 has a central opening 5 having a diameter which, in at least a partially expanded or stretched condition of band 4, is sufficient to pass over and tightly hold the tube 1 when the tube is compressed by folding or pleating, for example as shown in FIGS. 5 and 6.

Figure 3:
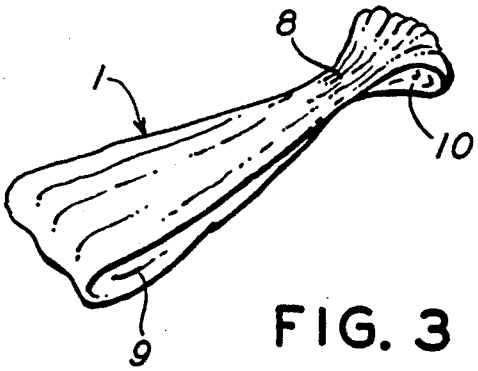
FIGS. 3 and 4 are perspective views, respectively, of the tube and the juxtaposed tube and ring, wherein the material of the tube is gathered into a compressed, pleated portion 8, forming two hollow sections 9 and 10 and , in FIG. 4, showing the ring 3 in position just prior to insertion of the section 10 through opening in the ring 3.
Figure 4:
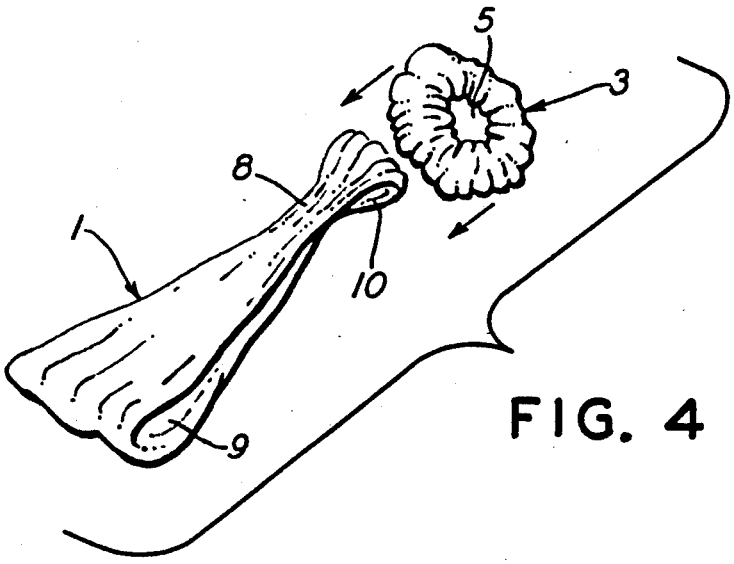

FIGS. 3 and 4 illustrate a partial pleating of tube 1 to form a constricted portion 8 dividing the tube into a larger hollow portion 9 and a smaller hollow portion 10 and in which condition of the tube the portion 10 can be inserted within the ring 3 with the opening 5 thereof positioned at the constricted portion 8. Such cooperation of the tube and ring components of the article illustrate the basic method of forming a variety of different functional and decorative arrangements of these components.

Figure 7:
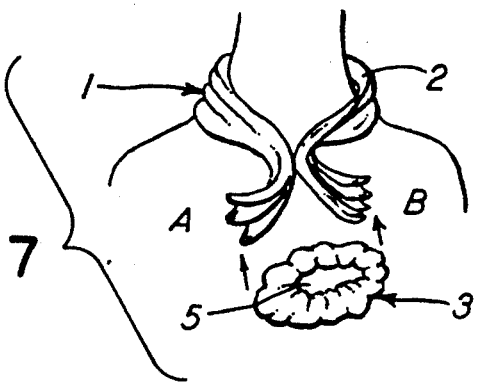
FIG. 7 is a perspective view of one stage in the formation of a choker having ends A and B with portions of the tube 1 juxtaposed as at position 13, with ring 3 in position to be slipped over tube ends A and B.

For example, in FIG. 7, tube 1, in pleated conditions, is placed about the neck of a wearer. The ring 3 is passed over the ends A and B of the tube to a constricted portion 13 of the tube, with the ends A and B flaring outwardly, thereby forming a scarf-like arrangement.

Figure 8:
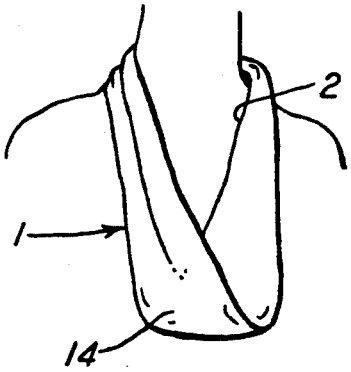
FIG. 8 is a perspective view of one form of a scarf formed from tube 1 wherein a portion 14 of tube 1 is dependent about a wearer's neck.
Figure 9:
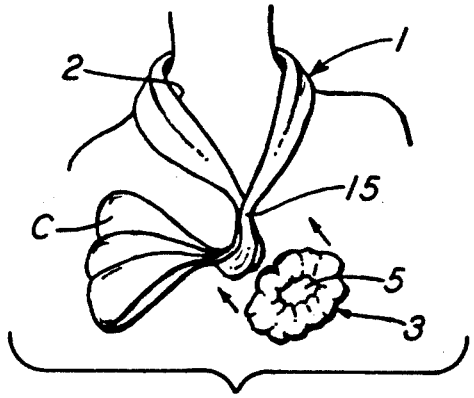
FIG. 9 is a perspective of another form of a partially-formed scarf. In this embodiment of the invention, the scarf of FIG. 8 is the starting point. Dependent portion 14 of tube 1 is gathered at position 15 leaving a free extremity C over which the ring 3 is passed to secure together the tube at position 15.
Figure 10:
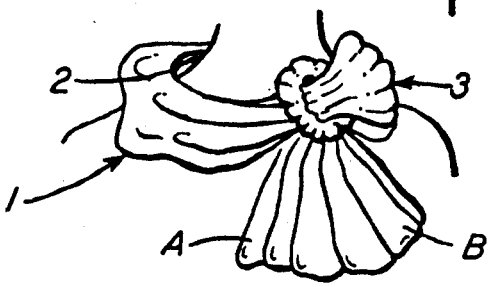
FIG. 10 is a perspective view wherein the partially-formed scarf of FIG. 9 is shown completed and in position about the neck of a wearer.
Figure 11:
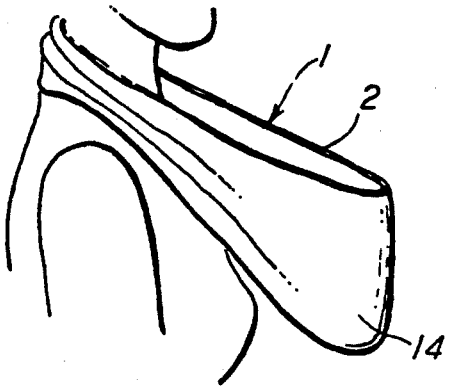
FIG. 11 a side view, in perspective, of a first stage of formation of a blouse-like arrangement of the tube and ring elements of the inventive article, wherein a hollow portion depends from a wearer's neck similar to the manner of FIG. 8.
Figure 12:
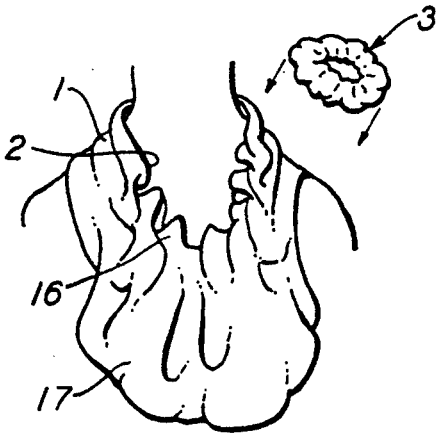
FIG. 12 is a front perspective view showing a second stage of forming a blouse-like arrangement of the tube and ring, in which pleats 16 in the material of tube 1 are gathered in the front of the wearer's neck and a portion 17 of tube 1 depends so as to form the blouse-like element of this arrangement.
Figure 13:
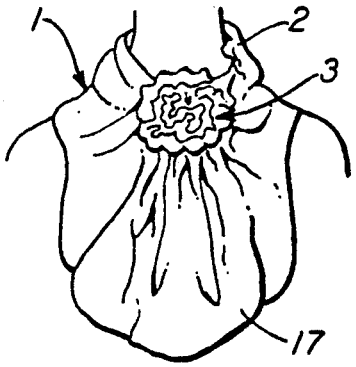
FIG. 13 shows the completed arrangement of FIGS. 11 and 12, and wherein the ring 3 has been slipped over the pleats 16, thus snuggling the opening 2 in tube 1 against the neck of the wearer and the ring 3 forms a decorative function as well as a practical one.

FIGS. 8-13 further illustrate the versatility of the article of the invention. Thus the tube 1 can be passed over a wearer's head with a portion 14 thereof depending upon the wearer's chest, thereby providing a simple, but decorative scarf as shown in FIG. 8. Alternatively, the portion 14 of FIG. 8 may be inserted through the opening 5 of ring 3 to a constricted portion 15 of the tube, thereby providing another form of scarf, as illustrated in FIG. 10. Yet further, the dependent portion 14 of tube 1, as shown in FIGS. 8 and 11, may be gathered into pleats as shown in FIG. 12 and the thus-pleated portion of the tube then secured by insertion of the portions of the pleats lying on the wearer's lower neck into opening 5 of ring 3. In this manner, when the wearer has a jacket on, the article would appear to be a blouse article of clothing as shown in FIG. 13.

Figure 15:
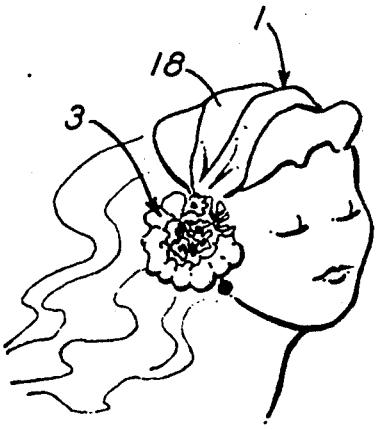
FIG. 15 shows a cap or hair ornament arrangement of the tube and ring formed by starting with the scarf arrangement of FIG. 14.
Figure 14:
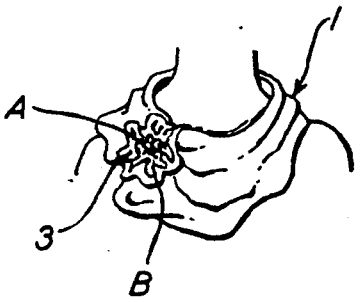
FIG. 14 shows another scarf arrangement of the tube and ring elements of the invention.
Figure 16:
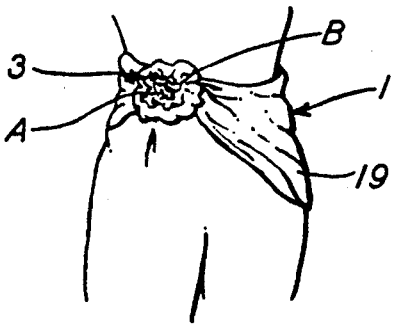
FIG. 16 is a perspective view of a belt-like arrangement of the tube and ring.

Another loosely fitting scarf arrangement, as illustrated in FIG. 14, may be formed, simply by securing together ends A and B by putting them through the ring 3. The same configuration of the tube and ring may be arranged as a hair covering as shown in FIG. 15 or as a belt as shown in FIG. 16.

Figure 17:
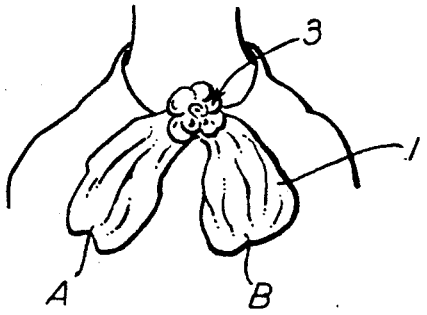
FIG. 17 is a perspective view of a bow or tie arrangement of the tube and ring.
Figure 18:
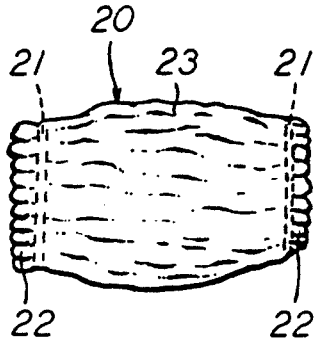
FIG. 18 is a side elevational perspective view of another, especially useful form of elastic-banded ring denoted generally by the numeral 20 wherein the ring is in the form of substantially a cylinder having a body 23 of flexible material such as a woven fabric, and extremities 22. Secured within fabric seams at the extremities of the ring 20 are two elastic members 22 denoted by dashed lines in FIG. 18.

In FIG. 17, the ring is positioned approximately in the middle of the tube which depends on either side of the ring in the form of bow which can be fastened in any suitable manner to a dress or similar article of clothing of the wearer.

The embodiment of the ring part 20 of the article of the invention as shown in FIGS. 19 and 20 is especially useful in that the double elastic members 21 provide greater holding power than a single band ring. Moreover, a cylindrical form of ring 20 provides a new and attractive appearance when associated with the tube 1. Upon compression of the cylindrical body 23, the ring 20 takes on an appearance somewhat similar to a single elastic member ring and such condition of the ring 20 may be used if such appearance is desired. The ring may contain more than two elastic members for even greater holding power.

Still another embodiment of the ring 20 is illustrated in FIGS. 20 and 21 in which a single elastic, band 24, shown in dashed lines in FIG. 21, is embedded within a gathered fabric 26 as shown in FIG. 20. The fabric is flounced, as at 27, flaring outwardly of the band 24 in upward and downward directions as shown in FIG. 20 and 21.

Many other arrangements ca be devised using the basic concept of the tube and ring elements of the article wherein, for most practical and decorative effects, the tube has a diameter D of about 16 to 26 inches and a width, W, of about 9 or 10 to about 14 or 15 inches. Such dimensions may be varied within such ranges to suit different anatomical dimensions of the wearer. A tube diameter of about 20 inches and a width of about 12 inches is especially preferred. Within such range, and with such dimensional selections, the various arrangements of the tube and ring will provide most effective fit and pleasing appearance.

What is claimed is:

1. An article of clothing comprising a first article part consisting of a flexible material formed in the shape of a hollow tube having a diameter of about 18 to 24 inches and a width of about 9 to 14 inches, and a second article part comprising a circular elastic member having, in a stretched condition an opening having a diameter sufficient to accommodate passage therethrough of the first member in a condition in which the first member is substantially fully folded in a direction along the diameter thereof.

2. An article according to claim 1, wherein the second article part comprises an elastic band and a shell of flexible material overlying an enclosing the elastic band.

3. An article according to claim 2, wherein each of the tube and the shell comprises a woven fabric.

4. An article according to claim 3, wherein the shell is in the form substantially of a torus.

5. An article according to claim 4, wherein the torus has a plurality of gathers such that upon expansion of the band to a substantially fully expanded condition, the gathered torus expands correspondingly.

6. An article according to claim 1, wherein the second article part comprises a plurality of elastic bands.

7. An article according to claim 6, wherein the second article part comprises a gathered tube having an elastic band secured to each of opposite ends of the tube.

8. An article according to claim 1, wherein the second article part encompasses the first article part and the first article part is decoratively arrangeable about a body member of a wearer.

9. An article according to claim 8, wherein the second article part encompasses the first article part in a direction along the diameter of the first article part.

10. An article according to claim 9 wherein the tube has a diameter of from about 18 to about 22 inches and a width of from about 10 to about 14 inches.

11. An article according to claim 9 wherein the tube has a diameter of from about 20 inches and a width of about 12 inches.

12. An article according to claim 9, wherein the second article part encompasses the first article part for a distance less than one half of the diameter of the first article part, thereby leaving sufficient space in the remainder of a hollow of the first article part to accommodate the neck of a wearer in a scarf-manner.

13. An article according to claim 12, wherein the second article part encompasses the first article part for a distance less than one half of the diameter of the first article part, thereby leaving sufficient space in the remainder of a hollow of the first article part to accommodate the waist of the a wearer in a belt manner.

14. A method of forming an article of clothing comprising:

a. providing a first article part consisting of a flexible hollow tube and a second particle part comprising a circular elastic member having, in a contracted condition an opening having a diameter sufficient to accommodate passage therethrough of the first member in a folded condition thereof and in a direction along a diameter thereof, and b. passing the second article part over the first article part a distance leaving a portion of the first article part of sufficient length to insert a body member of a wearer.

15. A method according to claim 14 for forming a choker, comprising folding the first article part repeatedly along a diameter of the tube, placing the folded tube about the neck of a wearer, pulling the second article part over the first article part a distance to draw the first article part snugly about the neck of the wearer.

16. A method according to claim 14 for forming a scarf, comprising placing the first article part about the neck of a wearer, with the wearer's head and neck extending through the hollow of the first article part with a portion of the first article part depending upon the chest of a wearer, pulling the second article part over the first article part a distance to draw the first article part loosely about the neck of a wearer.

17. A method according to claim 14 for forming a blouse comprising placing the first article part about the head of a wearer with the wearer's head extending through the hollow of the first article part, pulling the first article part snugly about the back of the wearer's neck, gathering a portion of an upper periphery of the first article part depending upon the wearer's chest into the form of a plurality of gathers, and placing the second article part over a portion of the gathers adjacent the periphery of the hollow of the first article part about a front part of the wearer's neck.

18. A method according to claim 14 for forming a decorative belt-like article of clothing from an article according to claim 1, comprising placing the first article part about the waist of a wearer, drawing the first article part snugly against the back of the wearer, gathering together in the front of the wearer's waist excess portions of the first article part, and securing together such excess portions of the first article part by inserting such excess portions into the opening of the second article part

19. A method for forming a decorative belt-like article of clothing from an article according to claim 4, comprising extending the first article part along the diameter thereof, gathering opposed ends of the extended first article part, placing together the gather opposed ends of the first article part, and placing the second article part over the juxtaposed, gathered ends of the first article part.

* * * * *

UNITED STATES PATENT AND TRADEMARK OFFICE

CERTIFICATE OF CORRECTION

PATENT NO. : 5,144,696

DATED : September 8, 1992

INVENTOR(S) : Judith A. Kahl

It is certified that error appears in the above-identified patent and that said Letters Patent is hereby corrected as shown below:

Column 1, line 36, after opening, insert --5--.

Column 3, line 49, delete "ca" and insert --can--.

Column 6, line 9, delete "like".

Signed and Sealed this

Thirtieth Day of November, 1993

*Attest:*

*Attesting Officer*

BRUCE LEHMAN

*Commissioner of Patents and Trademarks*